United States Patent [19]

Tunstall

[11] 4,420,042

[45] Dec. 13, 1983

[54] METHOD FOR CUTTING AND REPLACING TUBING WITHOUT KILLING WELL

[75] Inventor: Karl N. Tunstall, Dallas, Tex.

[73] Assignee: Otis Engineering Corporation, Dallas, Tex.

[21] Appl. No.: 355,183

[22] Filed: Mar. 5, 1982

[51] Int. Cl.[3] ..... E21B 29/08

[52] U.S. Cl. ..... 166/297; 166/55; 166/77

[58] Field of Search ..... 166/77, 297, 55, 55.1

[56] References Cited

U.S. PATENT DOCUMENTS

| | | | |
|---|---|---|---|
| 2,758,654 | 8/1956 | Simmons | 166/77 |
| 3,100,015 | 8/1963 | Regan | 166/77 X |
| 3,675,719 | 7/1972 | Slator et al. | 166/297 |
| 3,717,202 | 2/1973 | Burrow | 166/95 X |
| 3,993,137 | 11/1976 | Hefetz | 166/297 X |
| 4,151,881 | 5/1979 | Armstrong | 166/373 X |

OTHER PUBLICATIONS

Composite Catalog of Oilfield Equipment & Services–p. 4068–1974–1975.

Composite Catalog of Oilfield Equipment & Services–p. 3294–1948.

*Primary Examiner*—Ernest R. Purser

*Attorney, Agent, or Firm*—Vinson & Elkins

[57] ABSTRACT

A method of running and pulling a siphon tube from a well while the well is under complete pressure control in which the siphon tube is run through a special stack, cut off and suspended in the stack, the cut end is dressed in the stack and a pulling tube engages the siphon tube in the stack and the siphon is pulled.

3 Claims, 8 Drawing Figures

METHOD FOR CUTTING AND REPLACING TUBING WITHOUT KILLING WELL

This invention relates to siphon tubes and more particularly to a method of running and pulling a siphon tube while maintaining the well under complete pressure control.

In the past the handling of siphon tubes has been done with the wellhead open. In many instances this has required that the well be killed, which is generally undesirable.

While the technology has been known for severing a tube within a wellhead, this technology has not been applied to siphon tubing. See U.S. Pat. No. 3,993,137.

It is an object of this invention to provide a method of running and pulling a siphon tube from a well while maintaining the well under complete control.

Another object is to provide a method as in the preceding object in which a siphon tube is landed in a special stack, cut in two to provide a flow tubing in the well, then dressed and then engaged by a pulling tool to pull the siphon tube from the well.

In the drawings wherein the method of this application is illustrated and wherein like numerals indicate like parts:

Figure 1:
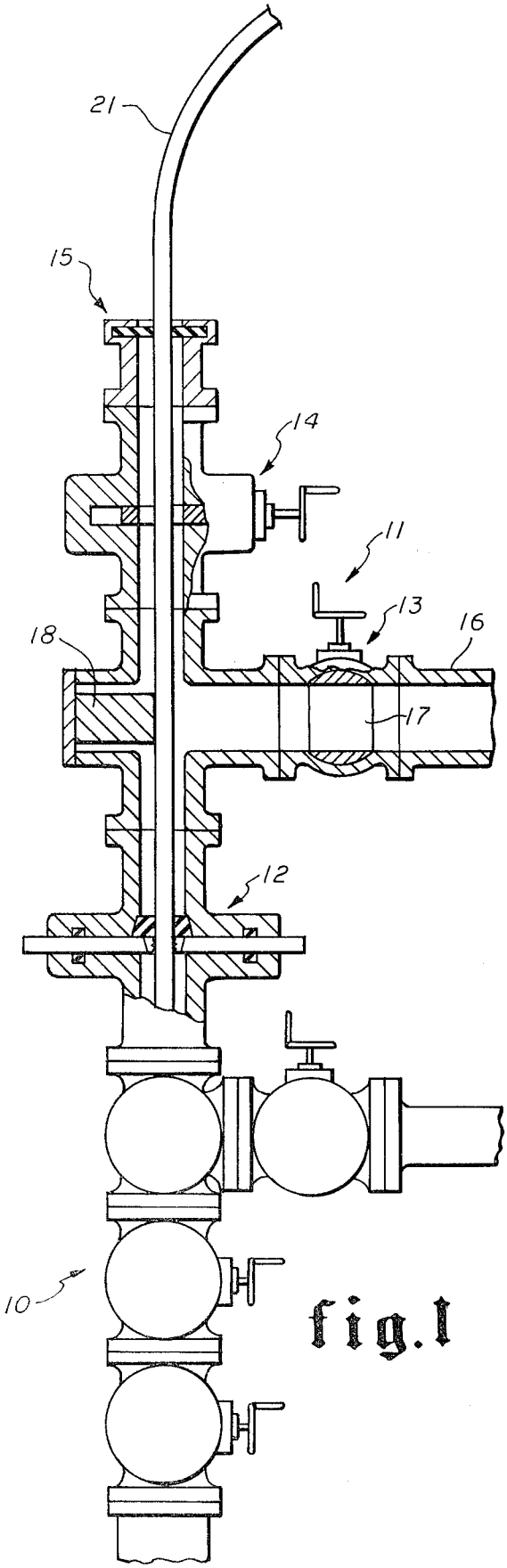
FIG. 1 is a view partly in elevation and partly in vertical cross-section illustrating a siphon tubing which has been run into a well and sealingly supported therein.
Figure 3:
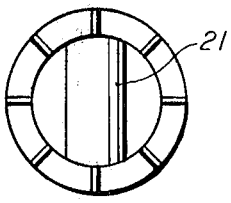
FIG. 3 is a view along the lines 3—3 of FIG. 2.

The various steps of the method are illustrated in the drawings and the method will be explained by reference to the drawings. It is understood, however, that the particular apparatus shown in the drawings forms no part of the invention and other apparatus may be substituted therefor.

A conventional wellhead is indicated at 10 in FIG. 1. When it is desired to run a siphon tube in the well, a siphon tube handling assembly indicated generally at 11 is secured to the top of the wellhead 10. This assembly 11 will include the sealing and supporting ram section indicated generally at 12, the wing valve indicated generally 13, the shutoff valve indicated generally at 14, and the stripper indicated generally at 15.

Considering the equipment used in more detail, the supporting and sealing equipment 12 is shown schematically to be a blowout preventer type of structure and the rams utilized may both seal and support as shown in the drawings or separate rams may be utilized to support and to seal as will be understood by those skilled in the art.

Figure 4:
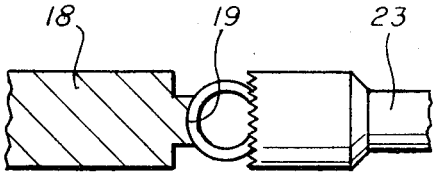
FIG. 4 is a view along the lines 4—4 of FIG. 2.

Supported on top of the sealing and support section 12 is the wing valve 13. The wing valve 13 provides for flow from the well into the outlet tube 16. The wing valve includes a ball 17 which will provide a full open bore through the wing valve. The wing valve is provided by a cross connector having in its leg opposite the ball 17 a support 18 having a contoured face 19 for supporting a pipe being cut as illustrated in FIG. 4. The shutoff valve 14 is supported on the wing valve. On top of the wing valve is a stripper assembly 15 which may take any desired form. A suitable stripper is illustrated in U.S. Pat. No. 3,216,731 to Dollison. The stripper is also sometimes referred to as a blowout preventer. The stripper prevents escape of well fluids during movement of a flow conductor into or out of the wellhead.

Figure 2:
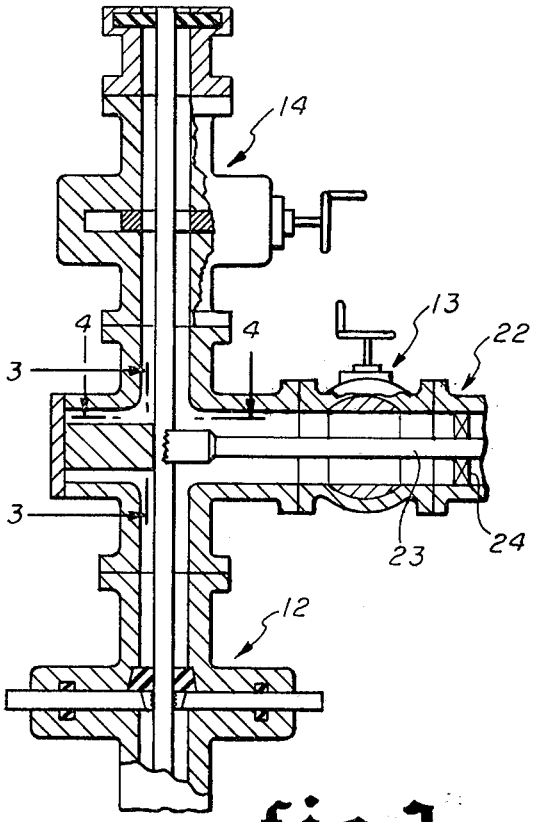
FIG. 2 is a view partly in elevation and partly in cross-section illustrating the siphon tubing being cut by a milling tool.
Figure 6:
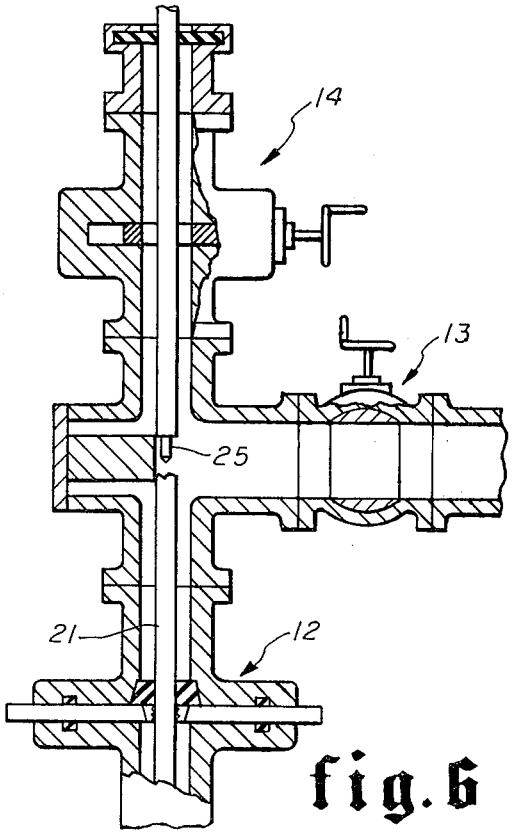
FIG. 6 is a view partly in elevation and partly in vertical section showing the top of the severed siphon tube being milled.

The milling tool shown in FIGS. 2 and 6 may be provided by any tool capable of being mounted on the wellhead and drilling under pressure such as the drilling equipment shown at page 4068 of the 1974–75 Composite Catalog of Oilfield Equipment and Services.

In practicing the method, the special wellhead equipment described above is mounted on the conventional wellhead 10. Utilizing conventional equipment, a siphon tube 21 is introduced into the well through the stripper 15, the wing valve 14 and the supporting and sealing structure 12 being open. The tubing may have adjacent its lower end an expendable plug such as the plug shown at page 3294 of the Composite Catalog of Oilfield and Pipeline Equipment for 1948. At any time after the siphon tube 21 has been run, the tube may be pressured up and expel this plug from its lower end. Preferably, the plug is expelled just before the well is placed on production.

When the siphon tube is run to the depth desired, the supporting and sealing structure 12 is activated to engage and support the tube and to seal thereabout in the conventional manner.

With the tubing supported in the well, the connection between the wing valve 13 and the flow pipe 16 is released and a suitable cutting tool indicated generally at 22 (FIG. 2) attached to the wing valve 13. The cutting tool includes a rotating shaft 23 provided with a suitable seal 24 so that it may be utilized under pressure conditions. The cutting tool is provided with means for severing the siphon tube 21. Preferably, the support means is provided by a backup member 18 which will hold the tube in place while it is being cut. Other means might be employed. For instance, see the teaching of U.S. Pat. No. 3,993,137 to Hefetz.

Figure 5:
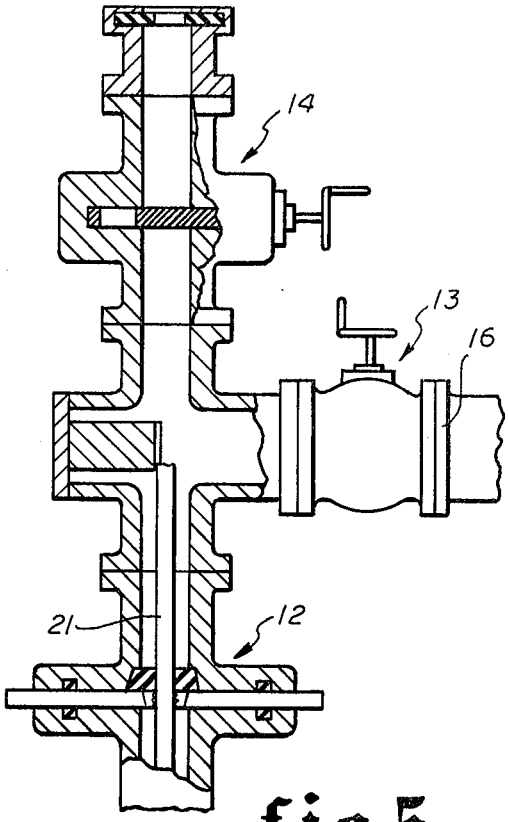
FIG. 5 is a view partly in elevation and partly in vertical section illustrating the well in condition to produce through the wing valve.

After the tube has been severed as illustrated in FIG. 2, the upper free section of the siphon tube is withdrawn and the wing valve 14 is closed as shown in FIG. 5. The cutting tool is removed and the outlet flowway 16 attached to the wing valve 13.

At this time, the well may be pressured up to expend the plug in the bottom of the tubing if such a plug were employed while running the tubing. With the shutoff valve 14 closed and the wing valve 16 open, the well may now be placed on production and remain on production as long as desired. Usually the stripper 15 will be removed during production.

If for some reason it is necessary to pull the siphon tube 12, such may be accomplished without killing the well, that is, leaving the well under its full pressure.

To provide for engaging the upper free end of the siphon tube 12, the upper end should be dressed to provide a smooth surface or to remove any damaged pipe. Preferably, this dressing step is carried out before the well is placed on production but the dressing step may be delayed until the tubing is pulled. It would particularly be desirable to dress the pipe before production if during the severing step the tube is damaged or bent into an out of round condition as might occur with shearing tools instead of the milling tools shown.

To dress the upper end of the siphon tube 12, the milling equipment is introduced through the stripper 15. As shown in FIG. 6, the milling equipment preferably includes a pilot or guide 25 which will enter into the bore in the siphon tube 12. Immediately above the guide 25 a milling surface is provided which will mill the top of the siphon tube 12 to provide a smooth surface so that a pulling tool may be introduced therein to pull the siphon tube.

Figure 8:
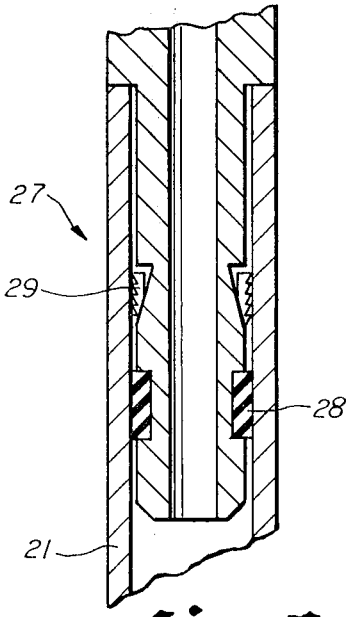
FIG. 8 is a view in vertical section illustrating the sealing and latching of the retrieving string to the upper end of the siphon tube.
Figure 7:
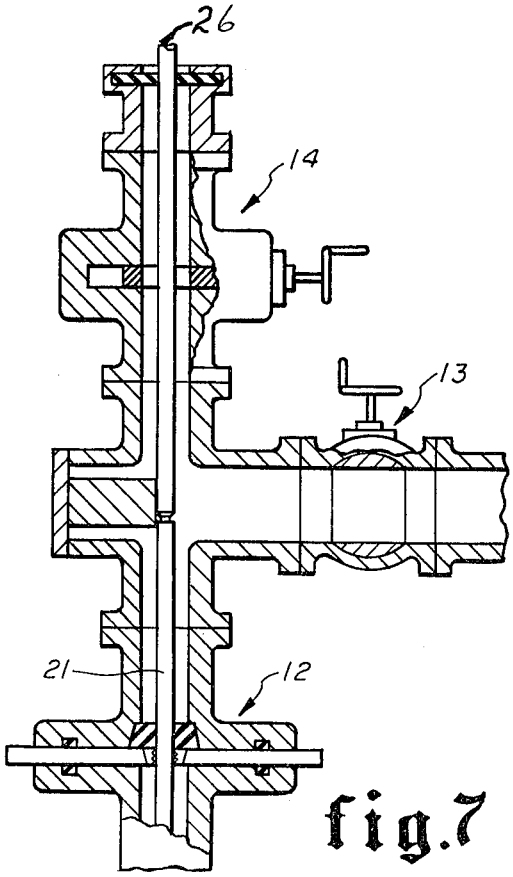
FIG. 7 is a view partly in elevation and partly in vertical section showing a retrieving string being made up in the upper end of the siphon tube.

After the tube is dressed, the milling equipment is removed and a retrieving string 26 introduced through the shutoff valve 14 as shown in FIG. 7. This tool will include any desired latching and sealing means such as the means shown generally at 27 in FIG. 8 which includes a seal 28 and latch slips 29 for engaging the siphon tube 21. Dressing of the upper surface of the siphon tube 21 will permit the latching and sealing tool 27 to be introduced into the siphon tube without damage to the latching tool so that it may latch and seal with the siphon tube.

The supporting means 12 is then released and the retrieving tool is then pulled to retrieve the siphon tube through the shutoff valve 14.

From the above it will be seen that the siphon tube may be run and pulled while the well is under pressure during all steps of the operation and it is not necessary to kill the well as the method provides for running and pulling the siphon tube while maintaining the well under complete control.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. The method of installing and removing a siphon tube from a well comprising:

positioning on a wellhead a stack comprising a sealing and supporting section, a side mounted wing valve, a top mounted shut off valve, and a stripper;

running a siphon tube through the stripper and shut off valve and into the well;

supporting the siphon tube in the stack on the support section;

sealing off the annulus between the stack and tubing below the wing valve;

severing the tubing with a tool inserted into the stack through the wing valve;

dressing the upper end of the siphon tube with a tool introduced into the stack through the shut off valve;

introducing through the stripper and shut off valve a pulling tube;

sealingly securing the pulling tube to the siphon tube;

releasing the means supporting the siphon tube and the support-siphon tube annulus sealing means;

and withdrawing the siphon tube through the shut off valve and stripper;

all of the steps of the method being carried out while the well is under pressure control.

2. The method of claim 1 wherein after the tubing is severed the stripper is removed and the well is placed on production.

3. The method of claim 1 wherein the siphon tube is run with a plug in the lower end thereof and after the tube is run, it is pressurized to expel the plug from the lower end of the siphon tube.

* * * * *